US007940231B2

(12) United States Patent
Moriyama et al.

(10) Patent No.: US 7,940,231 B2
(45) Date of Patent: May 10, 2011

(54) DISPLAY PANEL DRIVE-CONTROL DEVICE AND DISPLAY PANEL DRIVE-CONTROL METHOD

(75) Inventors: Seiichi Moriyama, Kyoto (JP); Hiroyuki Kageyama, Osaka (JP); Mamoru Seike, Osaka (JP); Jyunichi Suenaga, Osaka (JP)

(73) Assignee: Panasonic Corporation, Osaka (JP)

( * ) Notice: Subject to any disclaimer, the term of this patent is extended or adjusted under 35 U.S.C. 154(b) by 1078 days.

(21) Appl. No.: 11/727,469

(22) Filed: Mar. 27, 2007

(65) Prior Publication Data

US 2007/0222710 A1 Sep. 27, 2007

(30) Foreign Application Priority Data

Mar. 27, 2006 (JP) ..... 2006-085205
Mar. 20, 2007 (JP) ..... 2007-072229

(51) Int. Cl.
*G09G 3/28* (2006.01)
*G09G 3/36* (2006.01)

(52) U.S. Cl. ..... 345/60; 345/90; 345/98; 345/99; 345/100

(58) Field of Classification Search ..... 345/60, 345/98–101

See application file for complete search history.

(56) References Cited

U.S. PATENT DOCUMENTS

| | | | | |
|---|---|---|---|---|
| 5,828,357 | A * | 10/1998 | Tamai et al. | 345/89 |
| 6,831,621 | B2 * | 12/2004 | Nakano | 345/87 |
| 7,710,351 | B2 * | 5/2010 | Sano et al. | 345/60 |
| 2003/0174119 | A1 * | 9/2003 | Nishi et al. | 345/100 |
| 2004/0212561 | A1 | 10/2004 | Matsuda et al. | |
| 2008/0036749 | A1 * | 2/2008 | Moriyama et al. | 345/204 |

FOREIGN PATENT DOCUMENTS

| | | |
|---|---|---|
| JP | 2005-122107 | 5/2005 |
| JP | 2005-176298 | 6/2005 |
| JP | 2006-078935 | 3/2006 |

* cited by examiner

*Primary Examiner* — Bipin Shalwala
*Assistant Examiner* — Benyam Ketema
(74) *Attorney, Agent, or Firm* — McDermott Will & Emery LLP

(57) ABSTRACT

A first latch circuit temporarily memorizes a display pixel data by one line. A second latch circuit temporarily memorizes the display pixel data as a preceding display pixel data that precedes the display pixel data by one line. The load judging circuit judges a transition state of the display pixel data based on the display pixel data and the preceding display pixel data and predicts a drive load capacity CL based on a result of the judgment. A drivability adjusting circuit adjusts a signal level of the display pixel data based on a result of the prediction of the drive load capacity CL and adjusts drivability of an output.

5 Claims, 9 Drawing Sheets

FIG. 5

| a | | | b | | | c | d |
|---|---|---|---|---|---|---|---|
| scanning line n−1 | | | scanning line n | | | formulas for estimating capacitive load | estimates of assumed drive load |
| data electrode (k−1) column data | data electrode k column data | data electrode (k+1) column data | data electrode (k−1) column data | data electrode k column data | data electrode (k+1) column data | | |
| L | L | L | L | H | L | Cm_f + Cm_b + Cp | 20+20+30=70 |
| L | L | L | H | H | L | Cm_b + Cp | 20+30=50 |
| L | L | L | L | H | H | Cm_f + Cp | 20+30=50 |
| L | L | L | H | H | H | Cp | 30 |
| L | L | H | L | H | L | Cm_f + Cm_b *2 + Cp | 20+20*2+30=90 |
| L | L | H | H | H | L | Cm_b*2 + Cp | 20*2+30=70 |
| L | L | H | L | H | H | Cm_b + Cm_f + Cp | 20+20+30=70 |
| L | L | H | H | H | H | Cm_b + Cp | 20+30=50 |
| H | L | L | L | H | L | Cm_f *2 + Cm_b + Cp | 20*2+20+30=90 |
| H | L | L | H | H | L | Cm_f + Cm_b + Cp | 20+20+30=70 |
| H | L | L | L | H | H | Cm_f *2 + Cp | 20*2+30=70 |
| H | L | L | H | H | H | Cm_f + Cp | 20+30=50 |
| H | L | H | L | H | L | Cm_f*2 + Cm_b*2 + Cp | 20*2+20*2+30=110 |
| H | L | H | H | H | L | Cm_f + Cm_b*2 + Cp | 20+20*2+30=90 |
| H | L | H | L | H | H | Cm_f*2 + Cm_b + Cp | 20*2+20+30=90 |
| H | L | H | H | H | H | Cm_f + Cm_b + Cp | 20+20+30=70 |

CL e f

DISPLAY PANEL DRIVE-CONTROL DEVICE AND DISPLAY PANEL DRIVE-CONTROL METHOD

BACKGROUND OF THE INVENTION

1. Field of the Invention

The present invention relates to a display panel drive-control device and a display panel drive-control method for drive-controlling a display panel such as PDP (plasma display panel) in which a pixel serves as a capacitive load.

2. Description of the Related Art

In recent years, PDP, which has been paid attention as a display panel with a thin size, a large screen and a high definition, comprises a plurality of discharge cells each consisting of scan sustain electrodes arranged in a matrix shape and data electrodes intersecting with the scan sustain electrodes as pixels, and displays an image utilizing emission and non-emission when the discharge cells are discharged.

A general AC-type of PDP panel is provided with a plurality of scan sustain electrodes comprising scanning/sustain electrodes and sustain electrodes which are alternately arranged and a plurality of data electrodes arranged in a direction intersecting in orthogonal state with the scan sustain electrodes. After all of the discharge cells are initialized to be in a same sate by a reset operation, a scanning pulse is applied to the scanning/sustain electrodes. In synchronization with the application of the scanning pulse, a load drive signal, that is a data signal indicating display or non=display, is applied to the data electrodes. In the discharge cells selected in the signal application, wall charges are stored through charging/discharging. These processing are executed to all of the scan sustain electrodes. Next, a sustaining pulse is applied to the scanning/sustain electrodes and the sustain electrodes so that voltage polarities are switched alternately. Accordingly, the wall charges and the sustaining pulse voltage are superposed on each other in the discharge cells where the wall charges are stored, and a full-screen display is performed in such a manner that the light is emitted when a discharge threshold value is surpassed and the light is not emitted when the discharge threshold value is not surpassed. The image is displayed when the foregoing operations are repeatedly executed. Based on the principle of the display described above, it is possible to think that the PDP makes a capacitive load to be a driving target.

In a display panel drive-control device in which the capacitive load is made to be a driving target, it is necessary to realize multiple outputs and drivability with a high voltage in the display panel drive-control device that drives the data electrodes along with the advancements in increasing a screen size, definition and brightness in recent years. However, it is important at the same time to control EMI (electromagnetic interference) and a power supply noise due to the simultaneous change of the high-voltage drive outputs.

As an example of conventional measures for controlling and reducing such unnecessary radiations as the EMI and power supply noise, there is a first conventional example recited in No. 2005-122107 of the Japanese Patent Publications. According to the first conventional example, in a final output drive circuit of an output transistor comprising a high-potential side output element (PMOS transistor) and a low-potential side output element (NMOS transistor) in high-voltage circuit, a capacity is inserted between a connection point where the PMOS transistor and the NMOS transistor that are serially connected to constitute an inverter, and a gate of the PMOS transistor so that influences based on variation of driving load are fed back to the gate input. As a result, any acute change in a waveform of a load drive signal can be controlled.

Further, there is a second conventional example recited in No. 2005-176298 of the Japanese Patent Publications. According to the second conventional example, in a final output drive circuit comprising a Pch transistor and an Nch transistor in high-voltage circuit, an NMOS transistor connected to a gate of the Nch transistor is conducted so as to make the falling edge of the waveform of the load drive signal moderate. As a result, the generation of any noise can be controlled.

However, in the first conventional example wherein a drive load capacity changes depending on a size of the panel, it is necessary to provide capacity cells having a large capacity in view of a load due to the panel, which significantly increases a circuit area in the case of such a constitution that comprises wiring patterns intersecting with one another. Further, special capacity cells are needed because variability of the capacity cells influences a quality of the display, and a process that is different from a standard process is demanded.

The second conventional example, wherein the capacitive load which is not necessarily to be controlled is consequently controlled because the control is solely based on a state of a pixel signal to be displayed, results in an over-spec performance which unnecessarily makes the waveform of the load drive signal too dull.

SUMMARY OF THE INVENTION

Therefore, a main object of the present invention is to provide a display panel drive-control device and a display panel drive-control method capable of effectively controlling any acute change of a waveform of a load drive signal arising from variability of a drive load capacity due to changes of display data and controlling generation of EMI and a power supply noise.

In order to solve the foregoing problem, a display panel drive=control device according to the present invention comprises:

a first latch circuit for temporarily memorizing a display pixel data by one line;

a second latch circuit for temporarily memorizing a preceding display pixel data that precedes the display pixel data by one line;

a load judging circuit for judging a transition state of the display pixel data based on the display pixel data and the preceding display pixel data and predicting a drive load capacity based on a result of the judgment; and a drivability adjusting circuit for adjusting a signal level of the display pixel data based on a result of the prediction of the drive load capacity.

In the constitution, the display pixel data by one line that is fetched into the first latch circuit and temporarily memorized therein is outputted to the drivability adjusting circuit and the second latch circuit. The second latch circuit temporarily memorizes the preceding display pixel data by one line that has been already outputted to the display panel. The display pixel data and the preceding display pixel data are inputted to the load judging circuit, and the drive load capacity is predicted therein. The load judging circuit monitors the state of the data transition from the preceding display pixel data to the display pixel data, and sequentially predicts the drive load capacity generated when the display pixel data is applied to the capacitive load (constituting the pixel) based on a result of the monitoring. The prediction result is given to the drivability adjusting circuit. After that, the display pixel data by one line from the first latch circuit is fetched into the second latch circuit, and temporarily memorized therein as the preceding display pixel data by one line. The display pixel data by one line from the first latch circuit and the prediction result from the load judging circuit are inputted to the drivability adjusting circuit. The drivability adjusting circuit adjusts the signal level of the display pixel data based on the prediction result, and an amount of the adjustment of the signal level then is adjusted depending on the drive load capacity. Accordingly, the change of the waveform of the load drive signal applied to the capacitive load becomes dull depending on the reduction amount of the drivability. As a result, the acute change of the waveform, which was seen in the conventional technology (arising from that the drivability of the load drive signal was fixed at a high level), is controlled, and the generation of the EMI and the power supply noise can be thereby prevented.

The acute change of the waveform of the load drive signal can be controlled in either of the rising edge or the falling edge of the signal waveform.

There is an embodiment in the load judging circuit that the load judging circuit judges the transition state based on comparison of a group of data in a pixel region comprising a pixel of display target and adjacent pixels on both sides thereof in the display pixel data to a group of data in a preceding pixel region corresponding to the pixel region in the preceding display pixel data.

There is another embodiment in the load judging circuit that the load judging circuit judges whether or not the drive load capacity is below a predetermined drive load capacity based on comparison of the data of the pixels adjacent to the pixel of display target on both sides thereof in the display pixel data, and judges the transition state based on a result of the judgment.

There is yet another embodiment in the load judging circuit that the load judging circuit judges an operation margin in relation to the drive load capacity based on comparison of the data of the pixels adjacent to the pixel of display target on both sides thereof in the display pixel data to data of preceding pixels corresponding to the both-side pixels in the preceding display pixel data, and the drivability adjusting circuit adjusts the signal level of the display pixel data based on a judgment result of the operation margin.

There is yet another embodiment in the load judging circuit that the load judging circuit comprises a combinational logic circuit. The load judging circuit can generate a control signal through a simple logic comparison and can be realized by means of a low-voltage logical circuit. Therefore, an occupation area by the circuits necessary for the control can be suppressed, and a chip size can be thereby prevented from excessively increasing.

There is yet another embodiment that the drivability adjusting circuit comprises:

a signal level adjusting circuit for adjusting the display pixel data to have such a signal level that is necessary for the display; and a drivability adjustment output circuit for adjusting a drivability of the display pixel data that is level-adjusted by the signal level adjusting circuit in accordance with a drivability control signal by the load judging circuit.

When the display pixel data is applied to the capacitive load that is the pixel in the display panel, the signal level adjusting circuit raises the signal level of the display pixel data to such a level that is necessary for activation of the capacitive load. Then, if the signal level is maintained at the raised level, the drivability by the display pixel data is excessive in terms of the state of the data transition from the preceding display pixel data to the display pixel data. Accordingly, the acute change may appear in the waveform of the load drive signal applied to the capacitive load, which may cause the EMI and the power supply noise. Therefore, the display pixel data is inputted to the signal level adjusting circuit, and the drivability of the display pixel data whose signal level was raised by the signal level adjusting circuit is adjusted based on the drivability control signal by the load judging circuit. More specifically, the degree of the reduction of the drivability of the display pixel data is lessened when the drivability control signal shows that the drive load capacity is large, while the degree of the reduction of the drivability of the display pixel data is increased when the drivability control signal shows that the drive load capacity is small. Accordingly, the change of the waveform of the of the load drive signal applied to the capacitive load becomes dull in accordance with the degree of the reduction of the drivability, and the acute change of the waveform can be controlled. As a result, the generation of the EMI and the power supply noise can be prevented.

The signal level adjusting circuit may be configured to adjust, not only the signal level of the display pixel data from the first latch circuit, but also the signal level of the drivability control signal from the load judging circuit to the necessary signal level.

There is yet another embodiment that the display panel drive-control device may further comprises:

an output terminal for outputting the display pixel data; and a plurality of buffers connected in parallel to the output terminal, wherein the drivability adjustment output circuit selects the buffer to be driven from the plurality of buffers.

There is yet another embodiment that the drivability adjusting circuit comprises:

a plurality of drivability adjustment output circuits having different levels of drivability respectively; and a selector for selecting the drivability adjustment output circuit suitable for the drive load capacity from the plurality of drivability adjustment output circuits. According to the constitution, the drivability is adjusted based on a result of the selection, in other words, depending on which of the plurality of drivability adjustment output circuits is selected in accordance with the drivability control signal.

There is yet another embodiment that the display panel drive-control device further comprises a delay adjusting circuit for delaying an output timing of the display pixel data so as to synchronize the output timing with an output timing of the prediction result by the load judging circuit.

The operation in the load judging circuit is relatively complicated, and needs a certain amount of time. In response to this, the delay adjusting circuit delays the timing of outputting the display pixel data by one line to the drivability adjusting circuit to thereby synchronize the output timing with the timing of outputting the drivability control signal from the load judging circuit to the drivability adjusting circuit. Herewith, the load drive signal of the drivability corresponding to the predicted drive load capacity can be generated and outputted with an accurate timing.

In the foregoing constitution, there is yet another embodiment that a data shift circuit for fetching the display pixel data by one scanning line while shifting the display pixel data in accordance with a pixel clock is further provided in a former stage of the first latch circuit. In this case, the data shift circuit sequentially fetches the display pixel data serially inputted in accordance with the pixel clock, and outputs the fetched display pixel data to the first latch circuit in parallel.

A display panel drive=control method according to the present invention comprises a comparing step for comparing a group of display pixel data of three pixels in total, that are a pixel of control target $k_n$, and pixels $(k-1)_N$, and $(k+1)_n$ located adjacently on both sides thereof in a scanning line n, to a group of preceding display pixel data of three pixels in total, that are a pixel $(k)_{n-1}$ corresponding to the pixel of control target $(k)_n$, and pixels $(k-1)_{n-1}$ and $(k+1)_{n-1}$ located adjacently on both sides thereof in a scanning line n−1 immediately before the scanning line n;

a predicting step for monitoring a state of data transition from the preceding display pixel data to the display pixel data based on a comparison result obtained in the comparing step and predicting a drive load capacity based on an monitoring result; and a signal level adjusting step for adjusting a signal level of the display pixel data based on a prediction result.

Combinations of the transition modes from the group of preceding display pixel data by three pixels to the group of display pixel data by three pixels are considered in such a data transition state that "L" state of the display pixel data at the pixel $(k)_{n-1}$ in the line n−1 shifts to "H" state of the display pixel data at the pixel $(k)_n$ in the line n.

There are two combinations that are ("L", "L") and ("H", "L") with respect to a relationship between the preceding display pixel data at the pixel $(k-1)_{n-1}$ in the line n−1 and the preceding display pixel data at the pixel $(k)_{n-1}$ in the line n−1. There are two combinations that are ("L", "L") and ("L", "H") with respect to a relationship between the preceding display pixel data at the pixel $(k)_{n-1}$ in the line n−1 and the preceding display pixel data at the pixel $(k+1)_{n-1}$ in the line n−1. Therefore, there are 2×2=4 data combinations in the line n−1.

Furthermore, there are two combinations that are ("L", "H") and ("H", "H") with respect to a relationship between the display pixel data at the pixel $(k-1)_n$ in the line n and the display pixel data at the pixel $(k)_n$ in the line n. There are two combinations that are ("H", "L") and ("H", "H") with respect to a relationship between the display pixel data at the pixel $(k)_n$ in the line n and the display pixel data at the pixel $(k+1)_n$ in the line n. Therefore, there are also 2×2=4 data combinations in the line n.

As a result, the number of the data combinations in the lines n−1 and n are 4×4=16. There are five different drive load capacities corresponding to the 16 data combinations. The first order, the second order, the third order, the fourth order and the fifth order in drive load capacities show a distribution of (1, 4, 6, 4, 1) in the 16 data combinations, about which FIG. 5 can be referred to in the description of preferred embodiments. Because the drivability control signal can be generated in accordance with these five different drive load capacities so that the applied voltage with respect to the capacitive load can be finely adjusted, the change of the waveform of the load drive signal can be controlled with a high accuracy irrespective of various variation of the drive load capacity that is different from every display data.

By making use of the foregoing constitutions and the predictability of the drive load capacity, the acute change of the output waveform can be controlled while the chip size is further reduced at the same time. Output circuits respectively having two different levels of drivability are prepared previously in the drivability adjusting circuit so that one of the output circuits is selected depending on whether or not the predicted drive load capacity is at most a certain drive load capacity.

The signal level of the pixel $(k=1)_n$ and the signal level of the pixel $(k+1)_n$ are compared to each other, and it can be selected which of two kinds of the output circuits is used, based on a result of the comparison.

Further, the signal level of the pixel $(k-1)_{n-1}$ and the signal level of the pixel $(k-1)_n$ are compared to each other, and the signal level of the pixel $(k+1)_{n-1}$ and the signal level of the pixel $(k+1)_n$ are compared to each other. Then, it can be judged whether or not the drive load capacity is at most a predetermined value based on these comparison results.

By being configured as described above, the output circuit can be switched over depending on the drive load capacity.

According to the present invention the drivability of the display pixel data is adjusted depending on the drive load capacity different from every display data, and the acute change of the waveform of the load drive signal can be thereby controlled. As a result, the generation of the EMI and the power supply noise can be prevented.

Further, the present invention can be realized with the low-voltage logical circuit because the drivability control signal can be generated based on a simple logic comparison as a circuit configuration. Therefore, the occupied area by the circuits necessary for control can be reduced, which prevents the chip size from being excessively increased.

The display panel drive-control device and the display panel drive-control method according to the present invention have a function to control the acute change of the waveform of the drivability control signal caused by the variation of the capacitive load due to the change of the display pixel data, for example, it is useful for a data driver for driving data electrodes of PDP (plasma display panel). The device and the method can be further applied to a data display driver such as an EL panel having a capacitive emitting load.

BRIEF DESCRIPTION OF THE DRAWINGS

These and other objects as well as advantages of the invention will become clear by the following description of preferred embodiments of the invention. A number of benefits not recited in this specification will come to the attention of those skilled in the art upon the implementation of the present invention.

FIG. 5 shows an estimate diagram of a capacitive load in relation to FIGS. 3, 4*a* and 4B in the preferred embodiment.

DETAILED DESCRIPTION OF THE INVENTION

Figure 1:
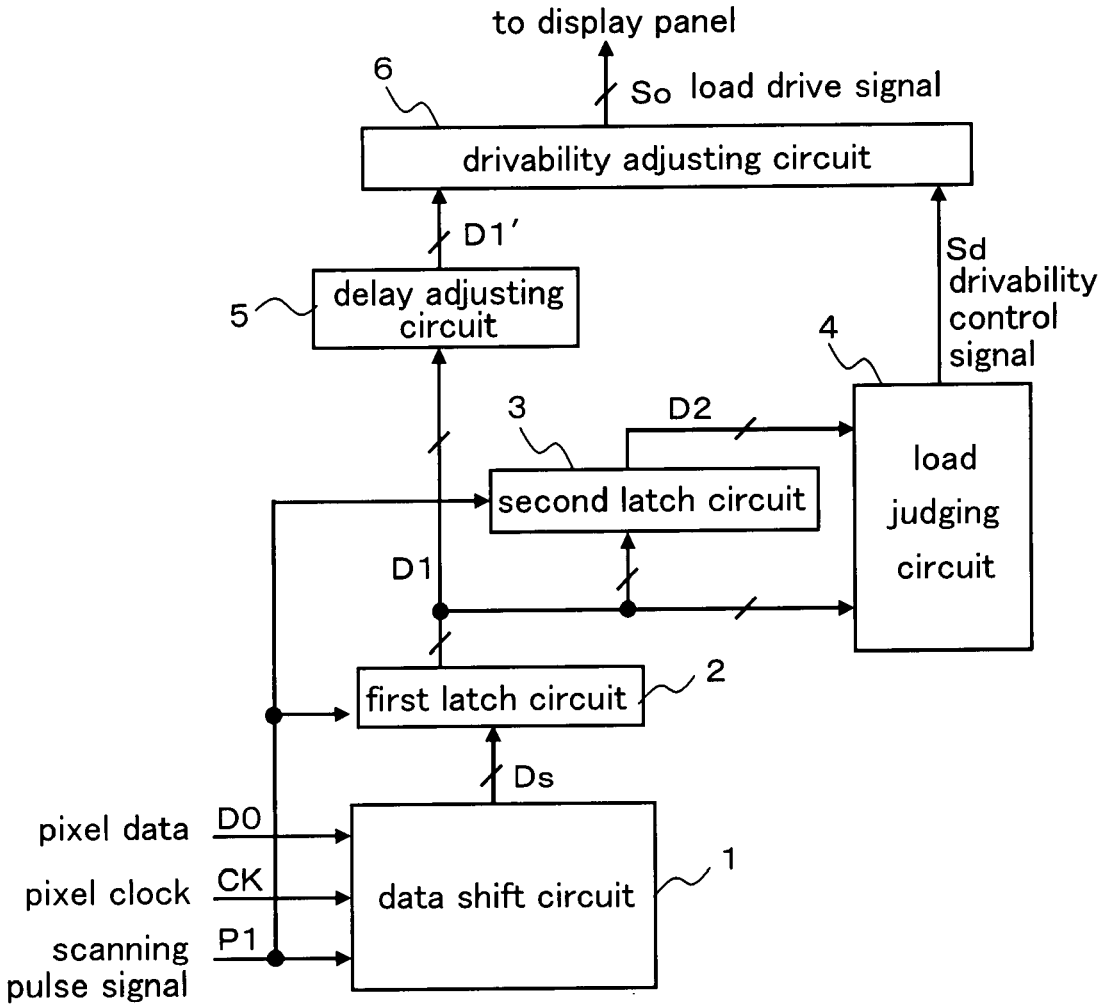
FIG. 1 is a block diagram showing a constitution of a display panel drive-control device according to a preferred embodiment of the present invention.

Hereinafter, a preferred embodiment of a display panel drive-control device and a display panel drive-control method according to the present invention is described in detail referring to the drawings. FIG. 1 is a block diagram showing a constitution of a display panel drive-control device according to the preferred embodiment. Referring to reference numerals shown in FIG. 1, 1 denotes a data shift circuit, 2 denotes a first latch circuit, 3 denotes a second latch circuit, 4 denotes a load judging circuit, 5 denotes a delay adjusting circuit, and 6 denotes a drivability adjusting circuit (buffer circuit). Further, D0 denotes a display pixel data to be displayed (hereinafter, referred to as display pixel data), CK denotes a pixel clock, and P1 denotes a scanning pulse signal.

The display pixel data D0, pixel clock CK and scanning pulse signal P1 are inputted to the data shift circuit 1, and the data shift circuit 1 fetches the display pixel data D0 by each pixel clock CK, stores a display pixel data Ds by one scanning line while shifting the fetched display pixel data D0, and outputs the stored display pixel data Ds by one line to the first latch circuit 2. A cycle of the scanning pulse signal P1 corresponds to a total of the pixel clocks CK by all of the pixels in one scanning line.

The scanning pulse signal P1 and the display pixel data Ds by one line from the data shift circuit 1 are inputted to the first latch circuit 2, and the first latch circuit 2 fetches and stores the display pixel data Ds at a timing of the scanning pulse signal P1, and then outputs the display pixel data D1 by one line to the second latch circuit 3 and the delay adjusting circuit 5.

The scanning pulse signal P1 and the display pixel data D1 by one line from the first latch circuit 2 are inputted to the second latch circuit 3, and the second latch circuit 3 fetches and stores the display pixel data D1 by one line at the timing of the scanning pulse signal P1, and outputs a display pixel data D2 by one line to the load judging circuit 4. The display pixel data D2 by one line has been already displayed earlier by one scan, and hereinafter, referred to as a preceding display pixel data D2.

As a result, the display pixel data D1 by one line to be displayed is stored in the first latch circuit 2, and the preceding display pixel data D2 by one line which has been already displayed in the previous one scan is stored in the second latch circuit 3.

The display pixel data D1 by one line from the first latch circuit 2 and the preceding display pixel data D2 by one line from the second latch circuit 3 are inputted to the load judging circuit 4, and the load judging circuit 4 judges a state of data transition from the preceding display pixel data D2 to the display pixel data D1 in each set of three pixels corresponding one another, and generates and outputs a drivability control signal Sd for adjusting a drive output of the drivability adjusting circuit 6 based on a result of the judgment. The details of the load judging circuit 4 will be described later referring to FIG. 6.

The delay adjusting circuit 5 fetches the display pixel data D1 by one line from the first latch circuit 2 and delays the fetched display pixel data D1 for a certain length of time, and outputs the delayed data to the drivability adjusting circuit 6 as a delayed display pixel data D1' by one line. The processing for delaying the data is executed in order to synchronize a timing of inputting the delayed display pixel data D1' to the drivability adjusting circuit 6 with a timing of inputting the drivability control signal Sd to the drivability adjusting circuit 6 by the load judging circuit 4.

The delayed display pixel data D1 by one line from the delay adjusting circuit 5 and the drivability control signal Sd from the load judging circuit 4 are inputted to the drivability adjusting circuit 6, and the drivability adjusting circuit 6 converts a voltage level of the delayed display pixel data D1' by one line into such a voltage level that is necessary for driving the display panel in accordance with the drivability control signal Sd. Accordingly, the drivability adjusting circuit 6 generates a load drive signal So adjusted so as to control any acute change of a waveform thereof and outputs the generated load drive signal So to the display panel. The details of the drivability adjusting circuit 6 will be described later referring to FIGS. 7 and 8.

Next, an operation of the display panel drive-control device according to the present preferred embodiment configured as described above is described in detail. The serial display pixel data D0 is fetched into the data shift circuit 1 by each pixel clock CK. The data shift circuit 1 stores the shifted display pixel data D0 as the display pixel data Ds by one scanning line, while shifting the fetched display pixel data D0. The data shift circuit 1 outputs in parallel the stored display pixel data Ds by one line to the first latch circuit 2 at the timing of the scanning pulse signal P1. The first latch circuit 2 stores the fetched display pixel data Ds by one line therein. At the same time, the first latch circuit 2 outputs the stored display pixel data D1 by one line to the second latch circuit 3 and the load judging circuit 4. The second latch circuit 3 stores the fetched display pixel data D1 by one line therein.

In the described state, the display pixel data D1 by one line to be displayed is stored in the first latch circuit 2, while the display pixel data D2 by one line, which has been already displayed earlier by one scan, is stored in the second latch circuit 3. The second latch circuit 3 outputs the stored display pixel data D2 by one line to the load judging circuit 4.

The display pixel data D1 by one line (output of the first latch circuit 2) and the preceding display pixel data D2 by one line (output of the second latch circuit 3) are inputted to the load judging circuit 4, and the transition states of the groups of display pixel data in each set of three pixels corresponding one another are judged. Based on a result of the judgment, the load judging circuit 4 generates and outputs the drivability control signal Sd for adjusting the drive output of the drivability adjusting circuit 6.

Meanwhile, the display pixel data D1 by one line (output of the first latch circuit 2) is fetched into the delay adjusting circuit 5. The delay adjusting circuit 5 delays the fetched display pixel data D1 by one line for a certain length of time to thereby generate the delayed display pixel data D1' by one line. The processing for delaying the data is executed in order to synchronize an output timing of the delayed display pixel data D1' to the drivability adjusting circuit 6 with a timing of inputting the drivability control signal Sd to the drivability adjusting circuit 6. At the time, the delay time is set in such a manner that the drivability control signal Sd is transmitted to the drivability adjusting circuit 6 slightly earlier than the delayed display pixel data D1' by one line.

The delayed display pixel data D1 by one line from the delay adjusting circuit 5 and the drivability control signal Sd from the load judging circuit 4 are inputted to the drivability adjusting circuit 6. The drivability adjusting circuit 6 converts a voltage level of the delayed shift data D1' by one line into such a voltage level that is necessary for driving the display panel in accordance with the drivability control signal Sd. Thereby, the drivability adjusting circuit 6 generates the load drive signal So whose drivability is adjusted so that the acute change of the waveform thereof is controlled, and outputs the generated signal So to the display panel.

Figure 2:
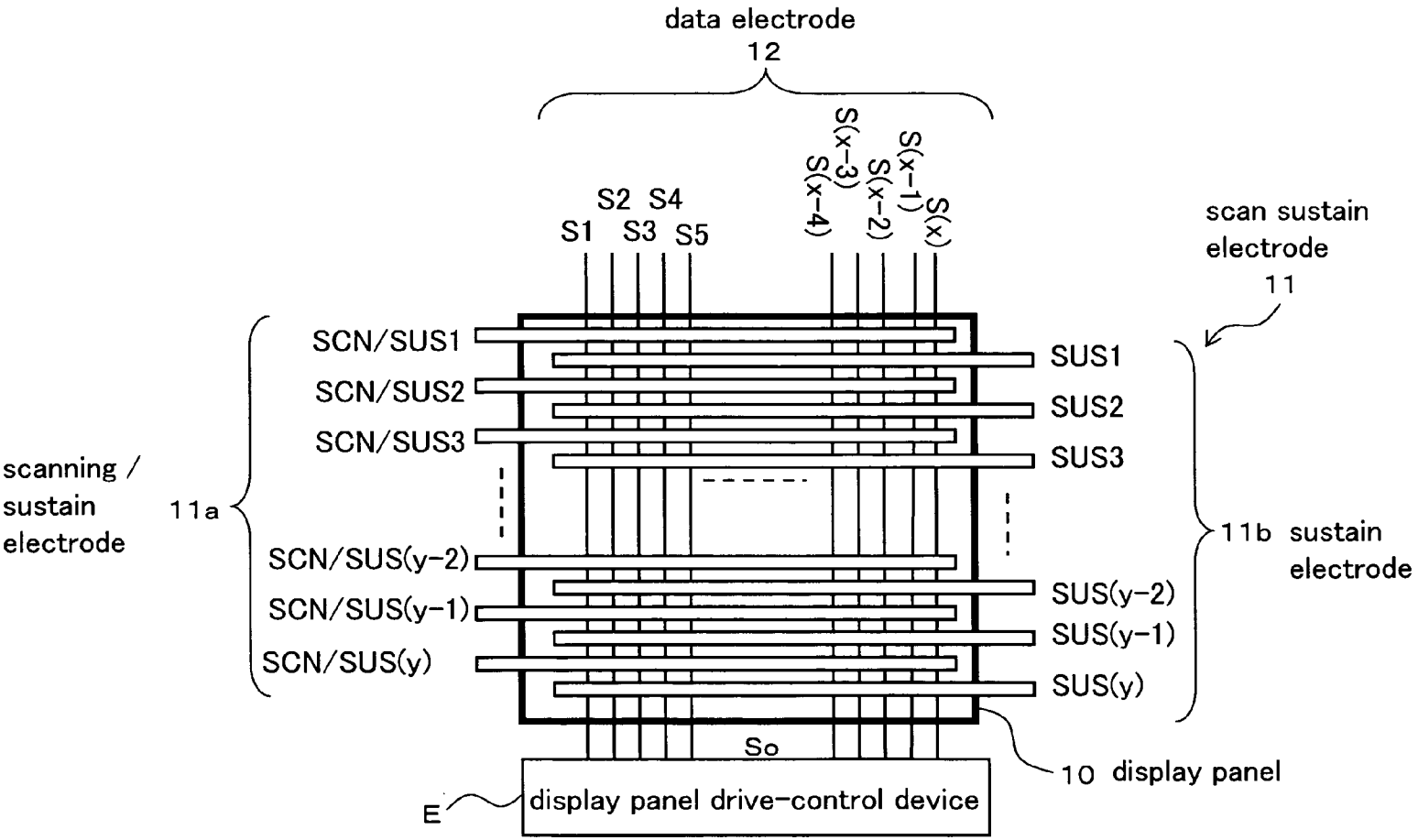
FIG. 2 is a schematic diagram showing a structure of electrodes of a conventional AC-type PDP (plasma display panel).

FIG. 2 is a schematic diagram showing a structure of electrodes in a conventional AC-type PDP. Referring to reference symbols shown in FIG. 2, E denotes a display panel drive-control device, 10 denotes a display panel, 11 denotes a scan sustain electrode, 11*a* denotes a scanning/sustain electrode, 11*b* denote a sustain electrode, and 12 denotes a data electrode. The combination of the scanning/sustain electrode 11*a* and the sustain electrode 11*b* constitute the scan sustain electrode 11.

In a panel of the conventional AC-type PDP, the scanning/sustain electrode 11*a* and the sustain electrode 11*b* in the display panel 10 comprise y pairs of scan sustain electrodes 11 which are adjacently and alternately placed, and x number of data electrodes 12 placed in a direction intersecting at right angles with the scan sustain electrodes 11. A region where the scan sustain electrode 11 and the data electrode 12 intersect with each other denote a pixel of display target, and referred to as a discharge cell.

After all of the discharge cells are initialized to be in a same state, one of the y numbers of scanning/sustain electrodes 11*a* is sequentially selected, and the scanning pulse signal P1 is applied to the selected scanning/sustain electrode 11*a*. In the display panel drive-control device E, the display pixel data by one line is generated in synchronization with the scanning pulse signal P1, and the load drive signal So, which is the display/non-display data signal corresponding to the display pixel data, is supplied to the data electrodes 12 in the display panel 10. The discharge cell located at the point where the data electrode 12 and the scanning/sustain electrode 11*a* intersect with each other is charged or discharged in accordance with the display /non-display load drive signal So, and wall charges are thereby stored in the discharge cell. The processing is executed in each of the y pairs of scan sustain electrodes 11 while performing the scan in the vertical direction.

Next, in a state where there is no voltage application to the data electrodes 12, a sustaining pulse is applied to the scanning/sustain electrodes 11*a* and the sustain electrodes 11*b* so that voltage polarities thereof are alternately switched. In the discharge cells where the wall charges are stored, the wall charges and the sustaining pulse voltage are superposed on each other. As a result, a full-screen display is performed in such a manner that the light is emitted when a discharge threshold value is surpassed and the light is not emitted when the discharge threshold value is not surpassed.

By repeating the foregoing operation, the image is displayed. Therefore, the discharge cells constituting the panel of the conventional AC-type PDP, that is the pixel elements, can be regarded as a capacitive load.

Figure 3:
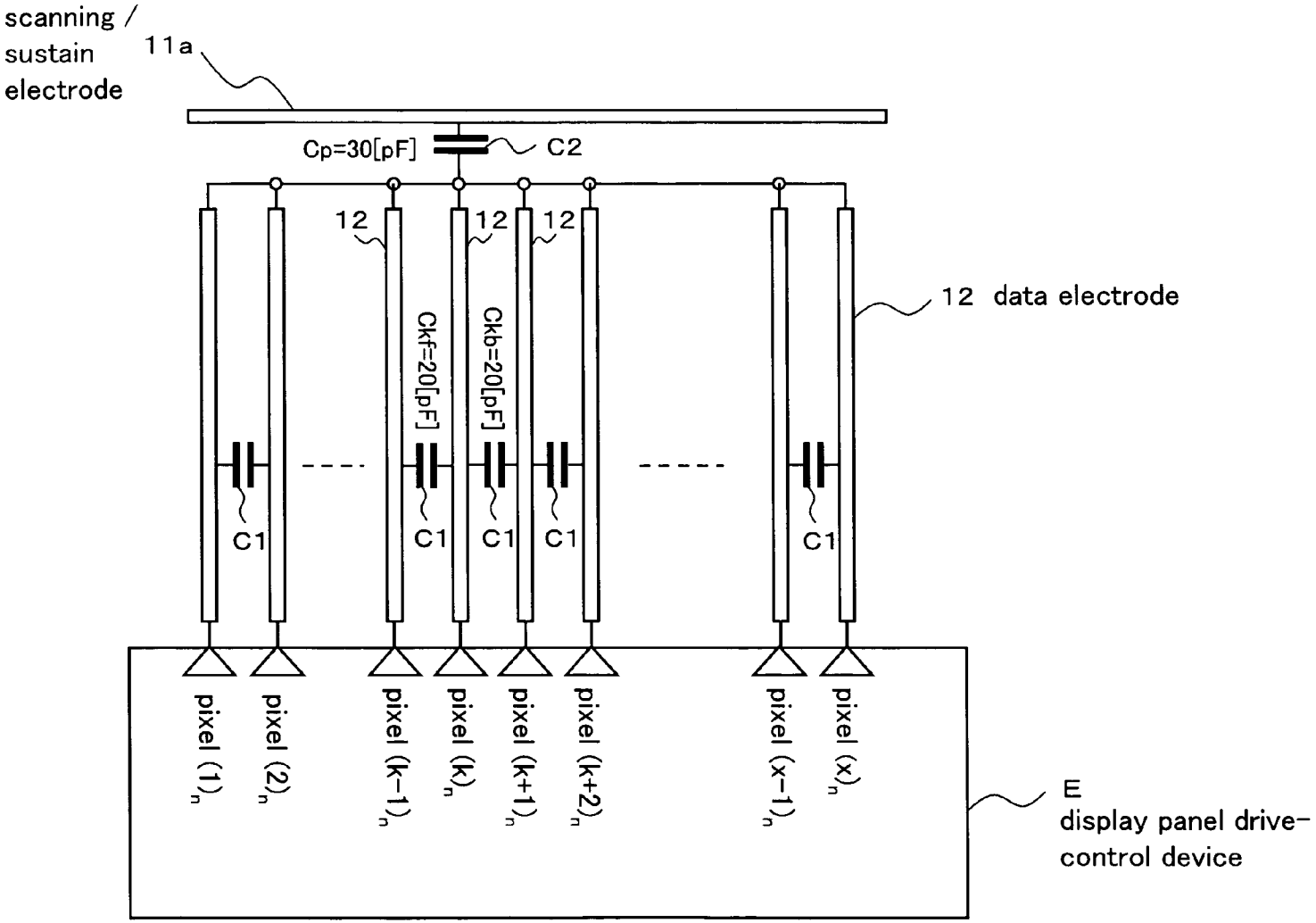
FIG. 3 is a conceptual diagram showing a drive load capacity of a pixel in the AC-type PDP.

FIG. 3 is a conceptual view showing a state of a drive load capacity CL generated in an electrode in a state where one of the y numbers of scanning/sustain electrodes 11*a* shown in FIG. 2 is selected and operated. Referring to reference symbols shown in FIG. 3, C1 denotes an inter-adjacent-electrode capacity formed between the targeted data electrode 12 and the data electrode 12 adjacent thereto, and C2 denotes an inter-opposing-electrode capacity formed between the targeted scanning/sustain electrode 11*a* and the targeted data electrode 12.

The drive load capacity of the discharge cell at a point where an arbitrary one of the scanning/sustain electrodes 11*a* and an arbitrary one of the data electrodes 12 intersect with each other can be regarded as a synthesized capacity between the inter-adjacent-electrode capacity C1 and the inter-opposing-electrode capacity C2. The inter-adjacent-electrode capacity C1 relatively changes by influences of the polarities of the adjacent data electrodes 12 and 12. Meanwhile, the inter-opposing-electrode capacity C2 is constantly maintained irrespective of the influences from the change of the polarities of the adjacent data electrodes 12 and 12. The inter-adjacent-electrode capacity C1 is divided into an inter-adjacent-electrode capacity Ckf between the relevant pixel and the preceding pixel and an inter-adjacent-electrode capacity Ckb between the relevant pixel and the subsequent pixel.

In order to simplify the description, it is assumed that the drive load capacity of the inter-adjacent-electrode capacity C1 is 20 [pF], the drive load capacity of the inter-opposing-electrode capacity C2 is 30 [pF], and an arbitrary line to be displayed is a line n, and a line prior to the line n is a line n−1. It is further assumed that the display pixel data of a pixel $(k-1)_{n-1}$ adjacent to an arbitrary pixel $(k)_{n-1}$ when the line n−1 is displayed is at the "L" level (ground level), the display pixel data of a pixel $(k)_{n-1}$ is at the "L" level, and the display pixel data of a pixel $(k+1)_{n-1}$ is at the "H" level. It is further assumed that the display pixel data of a pixel $(k-1)_n$ when the line n is displayed is at the "L" level, the display pixel data of a pixel $(k)_n$ is at the "H" level, and the display pixel data of a pixel $(k+1)_n$ is at the "L" level. It is further assumed that the inter-adjacent-electrode capacity between a pixel $(k-1)_x$ and a pixel $(k)_x$ in an arbitrary line x is Ckf, and the inter-adjacent-electrode capacity between the pixel $(k-1)_x$ and a pixel $(k+1)_x$ is Ckb, and the inter-opposing-electrode capacity C2 between them is Cp.

In a state where the pulse is applied to the scanning/sustain electrodes 11*a* in the line n−1, the display pixel data of the pixel $(k-1)_{n-1}$ is at the "L" level, the display pixel data of the pixel $(k)_{n-1}$ is at the "L" level, and the display pixel data of the pixel $(k+1)_{n-1}$ is at the "H" level. Because there is no potential difference between the pixel $(k-1)_{n-1}$ and the pixel $(k)_{n-1}$, the inter-adjacent-electrode capacity Ckf is Ckf=0 [pF]. Because there is a potential difference between the pixel $(k)_{n-1}$ and the pixel $(k+1)_{n-1}$, the inter-adjacent-electrode capacity Ckb is Ckb=20 [pF]. Accordingly, the drive load capacity, Cp=30 [pF], is generated, and the capacitive load in the line n−1 is Ckb+Cp=20+30=50 [pF].

Next, when the line n is displayed, the display pixel data of the pixel $(k-1)_n$ is at the "L" level, the display pixel data of the pixel $(k)_n$ is at the "H" level, and the display pixel data of the pixel $(k+1)_n$ is at the "L" level. Because there is a potential difference between the pixel $(k-1)_n$ and the pixel $(k)_n$ the inter-adjacent-electrode capacity Ckf=20 [pF]. Further, the inter-adjacent-electrode capacity Ckb is Ckb=20 [pF] since there is also a potential difference between the pixel $(k)_n$ and the pixel $(k+1)_n$. There is neither increase nor decrease in the inter-opposing-electrode capacity Cp, and it maintains 30 [pF] because the pulse is applied to the scanning/sustain electrodes 11*a* and there is no polarity change. The increase of the drive load capacity from the line n−1 to the line n is 20 [pF], as a result, the drive load capacity due to the transition of the display pixel data is 90 [pF].

Figure 4A:
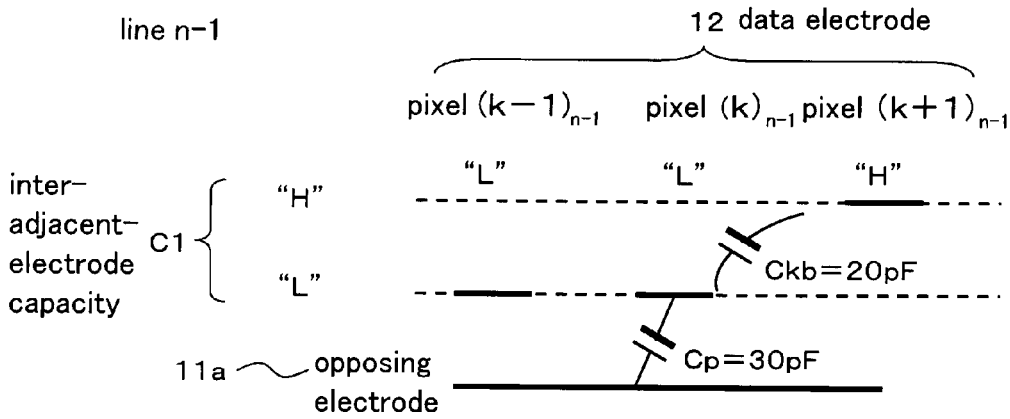
FIGS. 4A and 4B are conceptual views of a content assumed in FIG. 3 in the preferred embodiment.
Figure 4B:
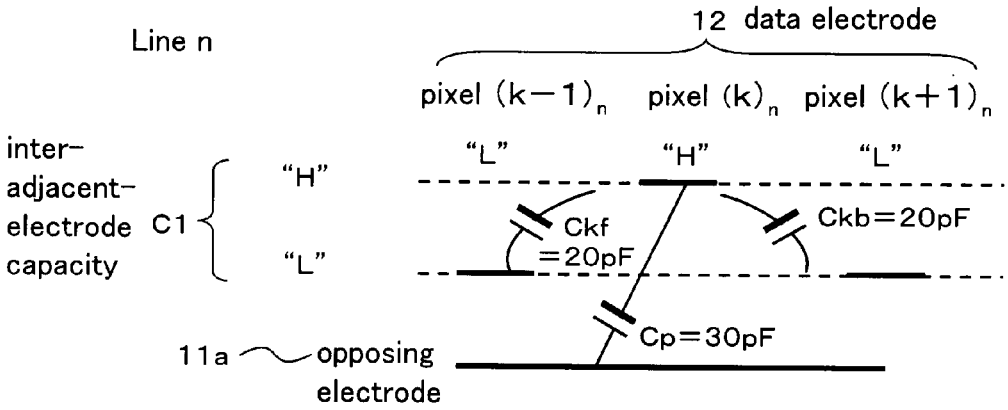

FIGS. 4A and 4B are conceptualized views of the assumed conditions in FIG. 3 in order to simplify the description. FIG. 4A shows a relationship between the inter-adjacent-electrode capacity C1 and the inter-opposing-electrode capacity C2, and the states of the display pixel data in the line n−1. FIG. 4B shows a relationship between the inter-adjacent-electrode capacity C1 and the inter-opposing-electrode capacity C2, and the states of the display pixel data in the line n.

When the polarities of the adjacent data electrodes 12 and 12 are different, the inter-adjacent-electrode capacity C1 is generated. When the polarities of the adjacent data electrodes 12 and 12 are the same, the inter-adjacent-electrode capacity C1 is not generated. In the state shown in FIG. 4 which corresponds to the line n−1, the display pixel data of the pixel $(k=1)_{n-1}$ is at the "L" level, the display pixel data of the pixel $(k)_{n-1}$ is at the "L" level, and the display pixel data of the pixel $(k+1)_{n-1}$ is at the "H" level. The inter-adjacent-electrode capacity Ckb between the pixels $(k)_{n-1}$ and $(k+1)_{n-1}$ is Ckb=20 [pF], and the inter-opposing-electrode capacity Cp between them is Cp=30 [pF].

In the state shown in FIG. 4 that corresponds to the line n, the display pixel data of the pixel $(k-1)_n$ is at the "L" level, the display pixel data of the pixel to be controlled $(k)_n$ is at the "H" level, and the display pixel data of the pixel $(k+1)_n$ is at the "L" level. The inter-adjacent-electrode capacity Ckf between the pixel $(k-1)_n$ and the pixel to be controlled $(k)_n$ is Ckb=20 [pF], and the inter-adjacent-electrode capacity Ckb between the pixel $(k+1)_n$ and the pixel to be controlled $(k)_n$ is Ckb=20 [pF]. The inter-opposing-electrode capacity Cp is constantly 30 [pF]. Estimate of the drive load capacity CL in the line n is, with the transition from the line n−1 added thereto, Ckf+ckb×2+Cp=20+20×2+30=90 [pF].

By performing such estimate about all of the display pixel data, the drive load capacity CL in each of the display pixel data is predicted. FIG. 5 shows the estimates of the capacitive load through combination with the transition of the states of the adjacent electrodes in the case where the state of the data electrode of the pixel (k) shifts from the "L" level to the "H" level with respect to the content described referring to FIGS. 3, 4A and 4B.

In FIG. 5, a denotes the states of three adjacent data electrodes in the line n−1, b denotes the states of three adjacent data electrodes in the line n, and c denotes formulas for the estimation of the capacitive load in the state transition from the state a to the state b, d denotes the drive load capacity value when the examples of the numeral values assumed in the description of FIGS. 3, 4A and 4B are applied to the formulas c for the estimation of the capacitive load, e corresponds to a state where the drive load in driving the data electrode of the pixel k) in the line n is minimum, and f corresponds to the states shown in FIGS. 4A and 4B.

4×4=16 data combinations is consequently generated from the four data combinations in the line n−1 and the four data combinations in the line n. The kind of five different drive load capacities which correspond to the 16 data combinations, are 30 [pF], 50 [pF], 70 [pF], 90 [pF], and 110[pF], 30 [pF], and a distribution thereof is (1, 4, 6, 4, 1) in the 16 data combinations.

Assuming that the capacitive load is driven with the same drive output, the waveform of the load drive signal sharply changes when load is at a minimum level. In the state e where the load is at the minimum level when the data electrode of the pixel to be controlled $(k)_n$ in the line n is driven in FIG. 5, only the inter-opposing-electrode Cp is generated, which corresponds to the state without the inter-adjacent-electrode capacities Ckf and ckb. In order to set the inter-adjacent electrode capacities Ckb and Ckf to Ckb=0 and Ckf=0, in the state where the data electrode of the pixel to be controlled $(k)_n$ in the line n is at the "H" level, it is necessary to set both of the data electrode of the pixel $(k-1)_n$ and the data electrode of the pixel $(k+1)_n$ to the "H" level, that is, (k−1, k, k+1)=("H", "H", "H").

In order to retain the inter-adjacent-electrode capacities Ckf and Ckb to Ckf=0, Ckb=0, the data electrode of the pixel $(k-1)_n$ may be at the "L" level, and the data electrode of the pixel $(k+1)_n$ may be at the "L" level in the change from the line n−1 to the line n because the data electrode of the pixel $(k)_{n-1}$ is the "L" level in the line n−1. More specifically, it may be (k−1, k, k±1)=("L", "L", "L").

Summarizing the observation described above, the drive load is at the minimum level in the case where the states of the three data electrodes shift from ("L", "L", "L") in the line n−1 to ("H", "H", "H") in the line n. The drive load at the time is only the inter-opposing-electrode capacity Cp. The sharpness in the rising edge of the waveform of the load drive signal is maximum at the time, and becomes dull at any other time.

The load judging circuit 4 judges the state of the load transition based on the observation described above. Then, the transition state is judged so that the drivability is adjusted. As a result, the display panel drive-control device according to the present preferred embodiment can prevent the steep rise of the applied voltage in the discharge cell of the pixel to be controlled k, in the line n to be displayed. In FIG. 5, the description is given based on the rising edge of the signal waveform of the drive load signal, however, the falling edge of the signal waveform can be similarly adjusted.

Figure 6:
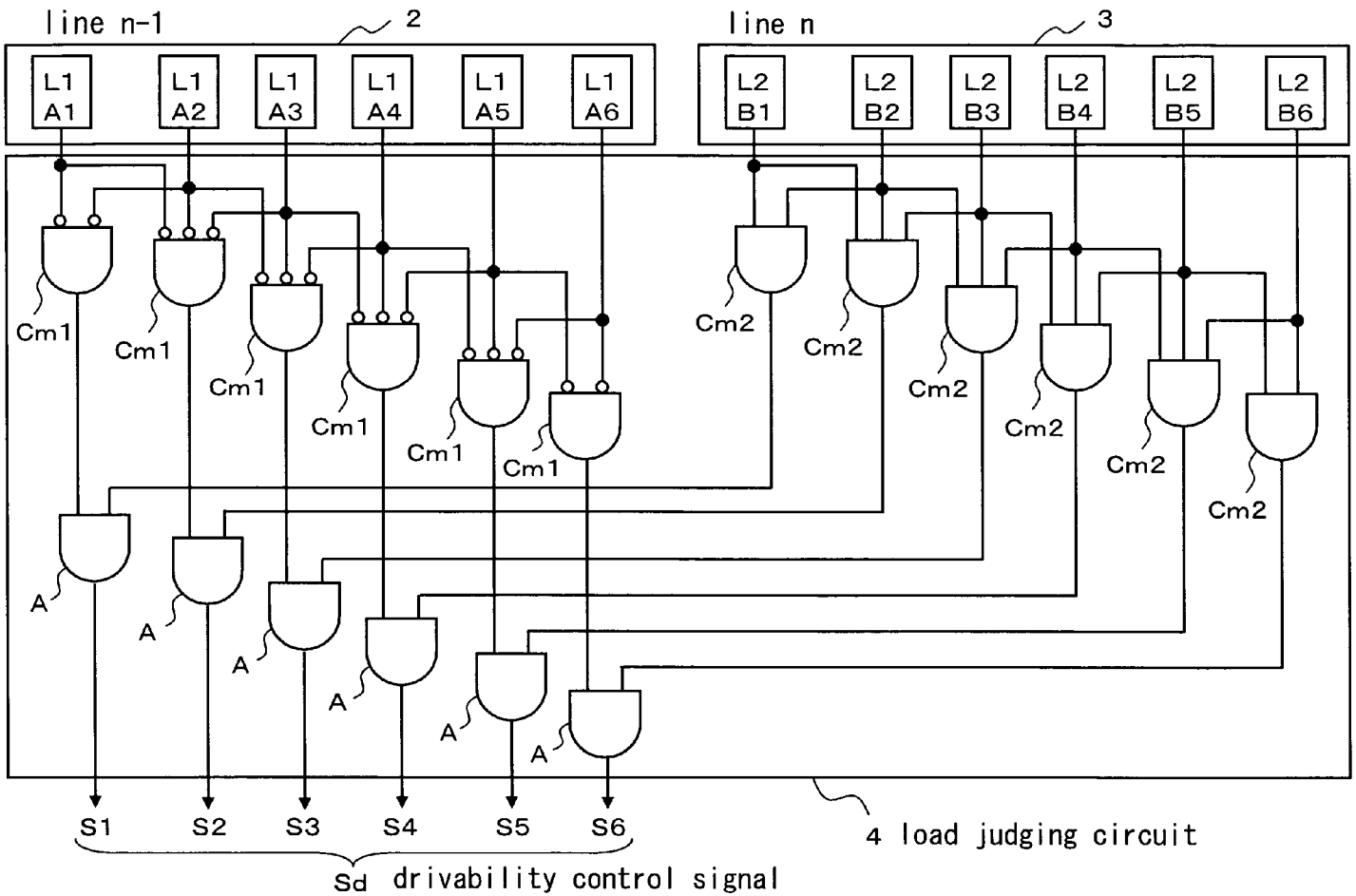
FIG. 6 is a circuit diagram showing an exemplified constitution of a drive load transition state judging circuit of the display panel drive-control device according to the preferred embodiment.

An exemplified circuit configuration of the load judging circuit 4 is described referring to FIG. 6. In FIG. 6, the circuit example for discriminating the state e where the capacitive load is minimum, which was described referring to FIG. 5, is shown by means of a positive logic. In order to simplify the description, bit numbers of the first latch circuit 2 and the second latch circuit 3 are assumed to be six bits.

Input terminals of first display pixel data comparing circuits Cm1 are connected to output terminals of the respective bits in the first latch circuit 2. Input terminals of second display pixel data comparing circuits Cm2 are connected to output terminals of the respective bits in the second latch circuit 3. Output terminals of these display pixel data comparing circuits Cm1 and Cm2 are connected to input terminals of display pixel data transition state judging circuits A. An AND gate where all of the inputs are logically inverted constitutes the first display pixel data comparing circuit Cm1. Thereby, the first display pixel data comparing circuits Cm1 judge if the data states of adjacent display pixels (three pixels) in the line n−1 are ("L", "L", "L"). An AND gate constitutes the second display pixel data comparing circuit Cm2. Thereby, the second display pixel data comparing circuits Cm2 judge if the data states of adjacent display pixels (three pixels) in the line n are ("H", "H", "H"). The display pixel data transition state judging circuits A judges the data change from ("L", "L", "L") to ("H", "H", "H"), and generates and outputs the drivability control, signal Sd. The judgment is carried out per bit. However, the data electrodes on the both ends respectively have only one adjacent data electrode on one side thereof. Therefore, the judgment is made on ("L", "L") or ("H", "H") for two inputs in the case of the both-end data electrodes.

The first display pixel data comparing circuits Cm1 judge if the adjacent display pixel data in the first latch circuit 2 in the line n−1 is ("L", "L", "L") or ("L", "L"), and set the outputs to the active level ("H" level) when it is ("L", "L", "L") or ("L", "L").

The second display pixel data comparing circuits Cm2 judge if the adjacent display pixel data in the second latch circuit 3 in the line n is ("H", "H", "H") or ("H", "H"), and set the outputs to the active level ("H" level) when it is ("H", "H", "H") or ("H", "H").

Based on the judgment results by the first and second display pixel data comparing circuits Cm1 and Cm2 described above, the display pixel data transition state judging circuits A judge if the data change from ("L", "L", "L") to ("H", "H", "H") or the data change from ("L", "L") to ("H", "H") is generated in from the lines n−1 to n, and set the outputs to the active level ("H" level) when either of the data changes occurs.

The outputs of the aforementioned display pixel data transition state judging circuits A correspond to one bit of the drivability control signal Sd. More specifically, out of the drivability control signals Sd consisting of six bits, the drivability control signal Sd corresponding to the data electrode of the pixel relevant to the data change from ("L", "L", "L") to ("H", "H", "H") or the data change from ("L", "L") to ("H", "H") becomes the "H" level. This corresponds to the detection of 30 [pF], that is the minimum level as the load of the relevant pixel. The drivability control signal Sd at the "H" level may be simultaneously generated for a plurality of bits.

FIG. 6 shows a logical circuit for detecting the drive load capacity CL=30 [pF]. Though not shown in the drawing, a logical circuit for detecting the drive load capacity CL=50 [pF], a logical circuit for detecting the drive load capacity CL=70 [pF], a logical circuit for detecting the drive load capacity CL=90 [pF], and a logical circuit for detecting the drive load capacity CL=110 [pF] can also be similarly configured. More specifically, the respective logical circuits can be realized in such a manner that it is adjusted whether or not the logical inversion (white circles) is provided in the inputs of the AND gates constituting the first and second display pixel data comparing circuits Cm1 and Cm2.

As well, though the positive logical circuit is shown in FIG. 6, a negative logic may be adopted. Further, the first and second latch circuits 2 and 3 are configured so as to consist of six bits (six pixels) in order to simplify the description. However, the bit number is not necessarily limited thereto, and may be any arbitrary bit number. As described above, the load judging circuit 4 can consist of the simple logical combinational circuits and a low voltage circuit.

Figure 7:
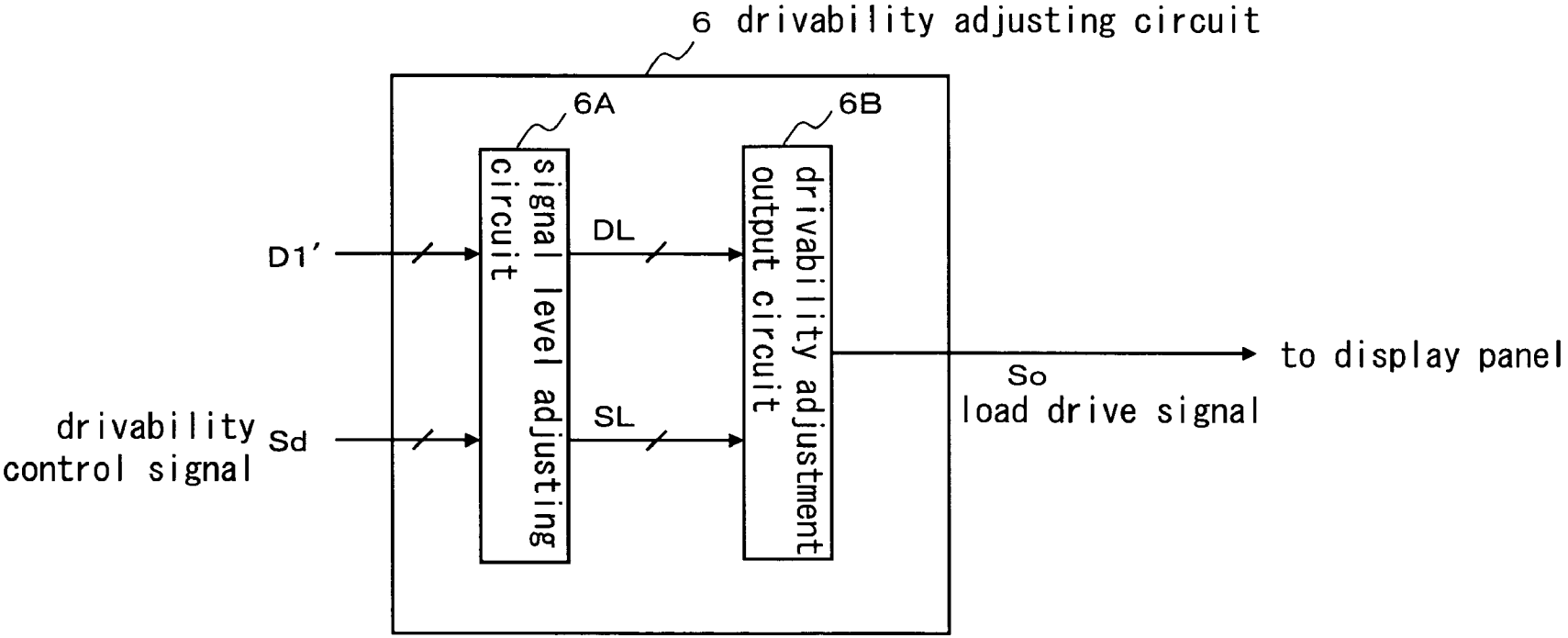
FIG. 7 is a block diagram illustrating a constitution of a drivability adjusting circuit of the display panel drive-control device according to the preferred embodiment.

FIG. 7 is a block diagram illustrating an exemplified constitution of the drivability adjusting circuit 6 in a low-order hierarchy thereof. In FIG. 7, 6A denotes a signal level adjusting circuit comprising, for example, a level shifter circuit, and 6B denotes a drivability adjustment output circuit. The delayed display pixel data D1 by one lien by the delay adjusting circuit 5 and the drivability control signal Sd by the load judging circuit 4 are inputted to the signal level adjusting circuit 6A, and the signal level of the delayed display pixel data D1' is adjusted to a high-voltage level necessary for driving the display panel. The signal level is adjusted based on the drivability control signal Sd. A drivability adjustment signal SL outputted from the signal level adjusting circuit 6A is inputted to the drivability adjustment output circuit 6B.

Figure 8:
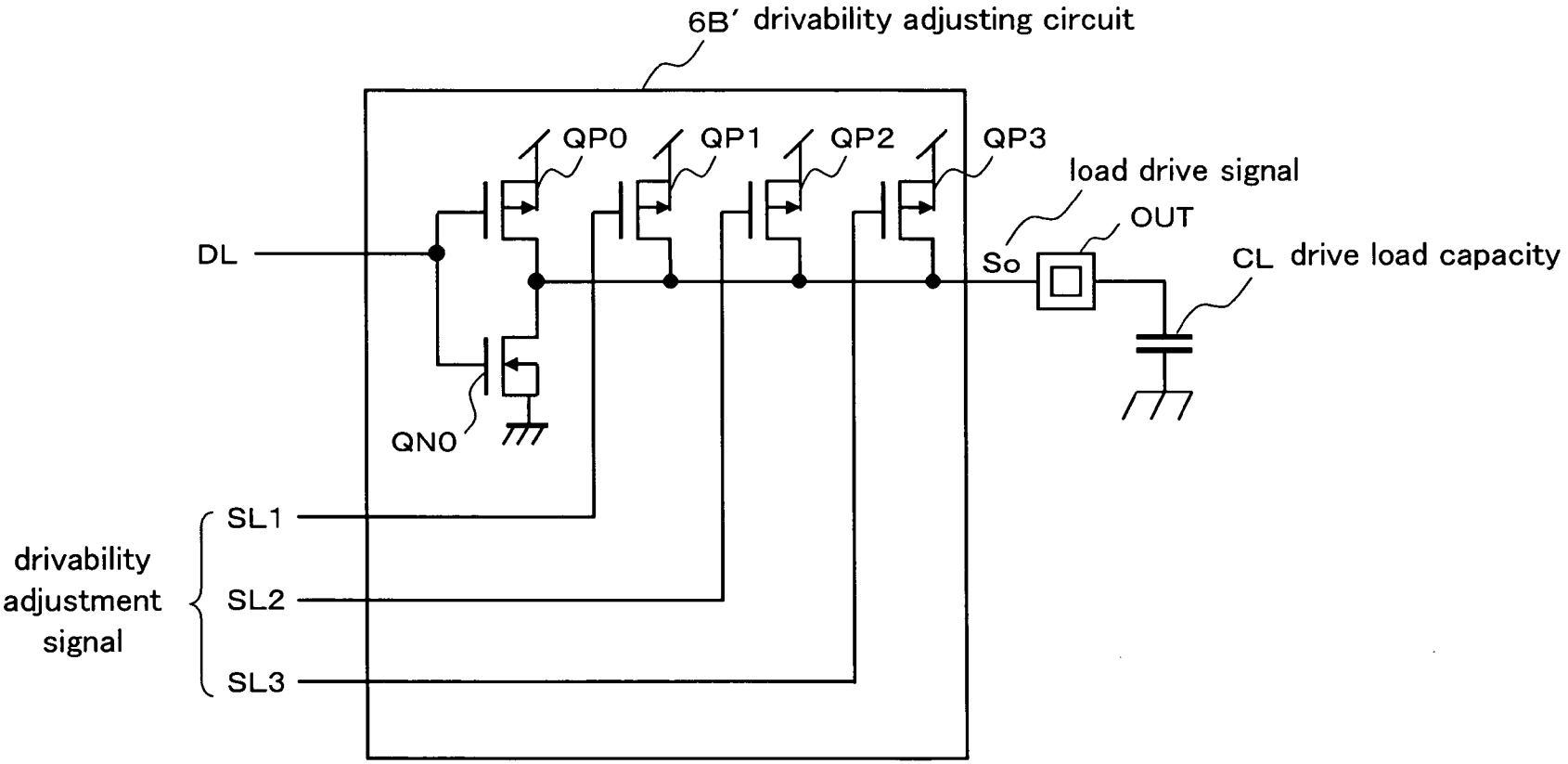
FIG. 8 is a circuit diagram illustrating a constitution of a drivability adjustment output circuit of the display panel drive-control device according to the preferred embodiment.

FIG. 8 shows an exemplified constitution of the drivability adjustment output circuit 6B in a low-order hierarchy thereof in focusing on an arbitrary one bit. Field-effect transistors of MOS (metal oxide semiconductor) type constitute a drivability adjustment output circuit 6B' by one pixel shown in FIG. 8. QP0 denotes a high-side PMOS transistor, QN0 denotes a low-side NMOS transistor, and QP1, QP2 and QP3 denote high-side PMOS transistors for adjusting the drivability. The drivability of the PMOS transistor QP0 for inverter is equivalent to the 10 [pF] driving. The drivability of the first PMOS transistor QP1 is equivalent to the 20 [pF] driving. The drivability of the second PMOS transistor QP2 is equivalent to the 40 [pF] driving. The drivability of the third PMOS transistor QP3 is equivalent to the drive of 60 [pF] driving. Such a high-side power supply voltage is applied to a source terminal. OUT denotes an output terminal, and CL denotes a drive load capacity. The drive load capacity CL is a capacitive load dynamically changing in the targeted discharge cell.

A display pixel data DL whose signal level is converted into such a signal level that is necessary for the display by the signal level adjusting circuit 6A is inputted to an input terminal of the inverter comprising the PMOS transistor QP0 and the NMOS transistor QN0. Drivability adjustment signals SL1, SL2 and SL3 whose signal levels are converted into such a signal level that is necessary for the display by the signal level adjusting circuit 6A are applied to the respective gates of the PMOS transistors QP1, QP2 and QP3 for adjusting the drivability.

The drivability adjustment signals SL1, SL2 and SL3 outputted from the signal level adjusting circuit 6A are inputted to the drivability adjustment output circuit 6B'. The drivability adjustment output circuit 6B' generates and outputs the load drive signal So in which the acute change of the waveform is controlled in accordance with the display pixel data.

It is assumed that the PMOS transistor QP0 for the inverter is ON, the NMOS transistor QN0 is OFF, and the three drivability adjustment signals SL1, SL2 and SL3 are all active ("L" level), that is, it is the combination of ("L", "L", "L"). In this state, the three PMOS transistors QP1, QP2 and QP3 are all ON, and the total drivability is equivalent to the 10+20+40+60=130 [pF] drive, and the relevant combination is unusable.

Next, it is assumed that only the first drivability adjustment signal SL1 is shifted to be inactive ("L" level), that is, the drivability adjustment signals SL1, SL2 and SL3 are a combination state of ("H", "L", "L"). Thus, only the first PMOS transistor QP1 is inverted to OFF, and the drivability equivalent to 20 [pF] is decreased. As a result, the total drivability is equivalent to the 110 [pF] driving. When the drive load capacity CL is judged to be 110 [pF] in this state, the drivability control signal Sd generated and outputted by the load judging circuit 4 are set to the combination of Sd=(SL1, SL2, SL3)=("H", "L", "L").

Next, it is assumed that only the second drivability adjustment signal SL2 is shifted to the inactive "L" level, that is, the drivability adjustment signals SL1, SL2 and SL3 are set to the combination of ("L", "H", "L"). Thus, only the second PMOS transistor QP2 is inverted to OFF, and the drivability equivalent to the 40 [pF] is decreased. As a result, the total drivability becomes equivalent to the 90 [pF]. When the drive load capacity CL is judged to be 90 [pF] in this state, the drivability control signals Sd generated and outputted by the load judging circuit 4 are set to the combination of Sd=(SL1, SL2, SL3)=("L", "H", "L").

Next, it is assumed that only the third drivability adjustment signal SL3 is shifted to the inactive "L" level, that is, the drivability adjustment signals SL1, SL2 and SL3 are set to the combination of ("L", "L", "H"). Thus, only the third PMOS transistor QP3 is inverted to OFF, and the drivability equivalent to 60 [pF] is decreased. As a result, the total drivability becomes equivalent to the 70 [pF] drive. When the drive load capacity CL is judged to be 70 [pF] in this state, the drivability control signals Sd generated and outputted by the load judging circuit 4 are set to the combination of Sd=(SL1, SL2, SL3)=("L", "L", "H").

Next, it is assumed that the first and third drivability adjustment signals SL1 and SL3 are shifted to the inactive "L" level, that is, the drivability adjustment signals SL1, SL2 and SL3 are set to the combination of ("H", "L", "H"). Thus, the first PMOS transistor QP1 and the third PMOS transistor QP3 are inverted to OFF, and the drivability equivalent to 20 [pF] and 60 [pF] are decreased. As a result, the total drivability becomes equivalent to the 50 [pF]. When the drive load capacity CL is judged to be 50 [pF] in this state, the drivability control signals Sd generated and outputted by the load judging circuit 4 are set to the combination of Sd=(SL1, SL2, SL3)=("H", "L", "H").

Next, it is assumed that the second and third drivability adjustment signals SL2 and SL3 are shifted to the inactive "L" level, that is, the drivability adjustment signals SL1, SL2 and SL3 are set to the combination of ("L", "H", "H"). Thus, the second PMOS transistor QP2 and the third PMOS transistor QP3 are inverted to OFF, and the drivability equivalent to 40 [pF] and 60 [pF] are decreased. As a result, the total drivability becomes equivalent to the 30 [pF]. When the drive load capacity CL is judged to be 30 [pF] in this state, the drivability control signals Sd generated and outputted by the load judging circuit 4 are set to the combination of Sd=(SL1, SL2, SL3)=("L", "H", "H").

The operation according to the present preferred embodiment is described in comparison to the conventional technology. In the conventional technology, the drivability applied to the data electrodes 12 is constantly maintained at a value equivalent to the 110 [pF] even when the drive load capacity CL largely changes due to the change of the display data (for example, such a change as 110 [pF]→90 [pF]→70 [pF]→50 [pF]→30 [pF]). Therefore, the drivability is excessively high when the drive load capacity CL is reduced. As a result, the waveform changes sharply, which causes the generation of the EMI and power supply noise.

On the contrary, according to the present preferred embodiment, the drivability is decreased in accordance with reduction of the drive load capacity CL, and the rising edge of the waveform in the load drive signal of the output terminal OUT which drives the drive load capacity CL thereby becomes dull. As a result, the waveform is prevented from sharply changing, which can avoid the generation of the EMI and power supply noise.

In addition, the constitution of the drivability adjustment output circuit 6B' shown in FIG. 8 is only an example, and the signal and control polarities may be possibly reversed. Further, the low-side MOS transistors for adjusting the drivability may be controlled. Further, only one MOS transistor for adjusting the drivability may be used. Further, a plurality of drivability adjusting circuits having a different levels of drivability from each other may be provided in regard to an arbitrary output terminal, and one of the plurality of drivability adjusting circuits may be selectively operated through using the drivability control signal Sd as a selection switch signal.

Figure 9:
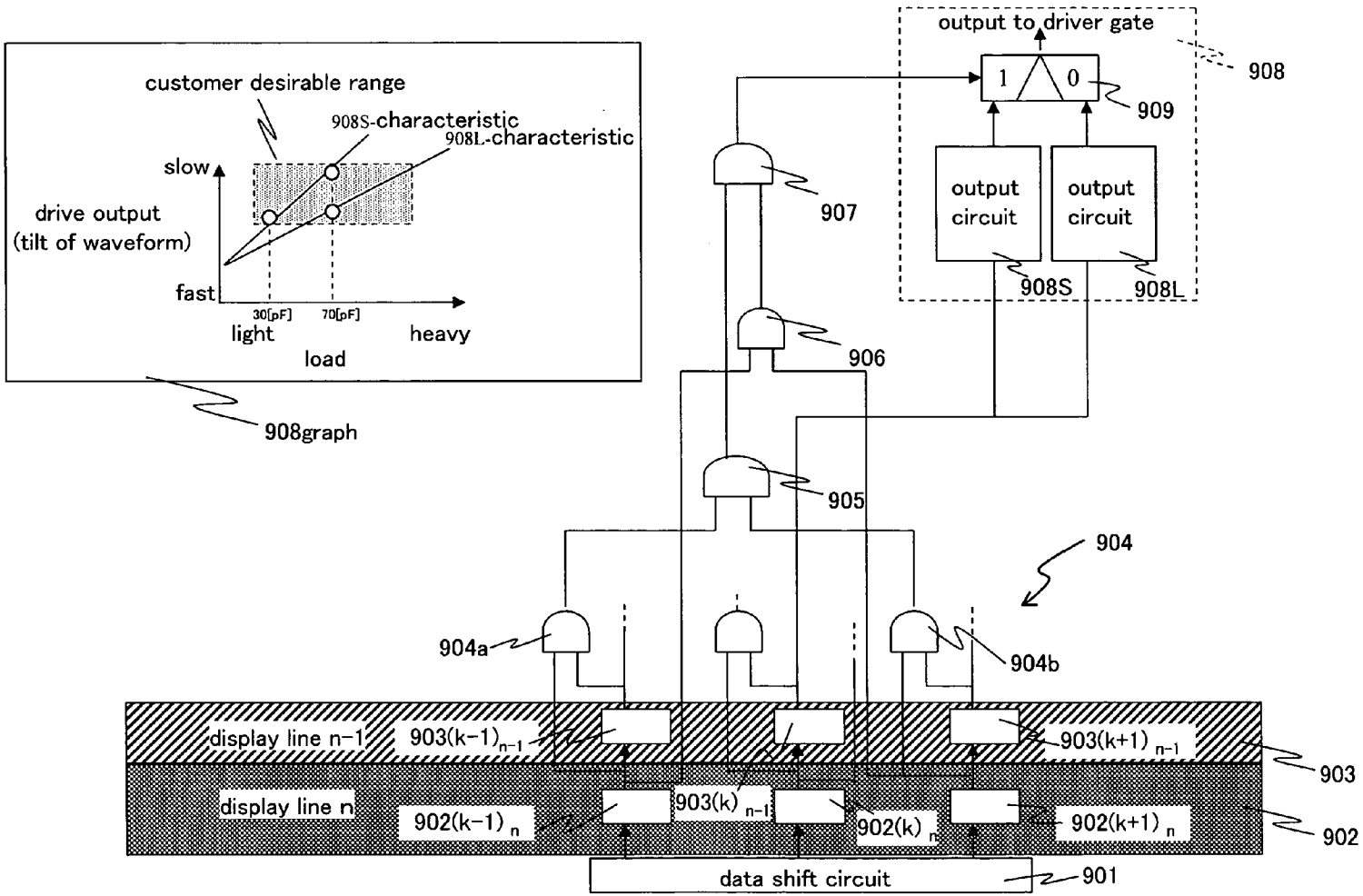
FIG. 9 is a schematic diagram showing an exemplified constitution in relation to a selective control part when output circuits respectively having two different levels of drivability are selected in accordance with the drive load capacity in case of focusing on the output of a pixel in the constitution of the drivability adjustment output circuit of the display panel drive-control device according to the preferred embodiment.

FIG. 9 shows an exemplified constitution of the drivability adjustment output circuit of the display panel drive-control device according to the present preferred embodiment. The example shows a constitution of a selection control circuit for selecting one of output circuits having two different levels of drivability in accordance with the drive load capacity.

In FIG. 9, 901 denotes a data shift circuit, 902 denotes a first latch circuit, 903 denotes a second latch circuit, 904, 905, 906 and 907 denote a load judging circuit, and 908 denotes a drivability adjusting circuit. The drivability adjusting circuit 908 corresponds to the drivability adjusting circuit 6 shown in FIG. 1. The drivability adjusting circuit 908 comprises output circuits 908S and 908L having different levels of drivability from each other, and a selecting circuit 909 for selecting one of outputs in the output circuits 908S and 908L. A 908 graph schematically shows a relationship between drive outputs and loads of the output circuits 908S and 908L. In order to simplify the description, it is assumed that the pixel to be controlled is a pixel 902 $(k)_n$ in the line n, and further it is assumed that the drive load capacity serving as a threshold value when the output circuits 908S and 908L are switched over is 70 [pF] pursuant to the description content in FIGS. 3, 4 and 5.

When the drive load capacity is more than 70 [pF], it is necessary to select the output circuit 908L having the larger drivability. When the drive load capacity is below 70 [pF], it is necessary to select the output circuit 908S having the smaller drivability. Referring to the estimate table of the capacitive load shown in FIG. 5, there are five different drive load capacities, 30 [pF], 350 [pF], 70 [pF], 90 [pF], and 110 [pF]. The minimum drive load capacity is 30 [pF], and the output circuit 908S having the 908S-characteristic in the 908 graph is selected so that the acute change of the waveform is not generated in this state. When the drive load capacity is below 70 [pF], the output circuit 908S can be used for driving. However, when the drive load capacity is increased to be larger than the threshold value (approximately 70 [pF] in the present example) and the output circuit 908S is then used, the drive output response is beyond a demanded range. Therefore, when the drive load capacity exceeds 70 [pF], the output circuit 908L having the 908L-characteristic in the 908 graph is selected. As a result, the drive output response can stay within the demanded rage even though the drive load capacity exceeds 70 [pF]. When the drive load capacity is approximately 70 [pF], the drivability characteristic can stay within the demanded range even when either of the output circuits 908S and 908L is selected.

The switchover selection of a particular 70 [pF] output circuit among a plurality of 70 [pF] circuits is described below. As shown in FIG. 5, there is a plurality of manners in the transition of the display pixel data even when the predicted drive load capacity is the same, and the respective transition manners are subject to influences from variable conditions and the like .in a manufacturing process and an operating environment. Further, the influences are different in each of the transition manners, which make the characteristics of the output circuits 908S and 908L versatile. Hereinafter, description is given to the versatility of the characteristics of the output circuits 908S and 908L in the drive load capacity 70 [pF] selected as an example of the threshold value.

It is assumed that the data of the pixel 902 $(k=1)_n$ and the pixel 902 $(k+1)_n$, which are adjacent to the pixel to be controlled 902 $(k)_n$, in the line n, are both "H", and the data of the pixel 903 $(k-1)_{n-1}$ and the pixel 903 $(k+1)_{n-1}$, which are adjacent to the pixel 903 $(k)_{n-1}$ in the line n−1, are both "H". This is an example of the data transition manner in which only the pixel to be controlled 902 $(k)_n$ changes. In such a state, the transition is more easily subject to the influences from the variable conditions, and the output more easily shows a sharp change in both of the characteristics of the output circuits 908S and 908L. In consideration of this, the output circuit 908S is selected in the case of the foregoing transition manner even though the drive load capacity is 70 [pF].

Assuming that the output circuit 908L is selected in the normal state, the drive load capacity is compared to the threshold value (70 [pF]) in this state. The load drive capacities smaller than the threshold value (70 [pF]) are 50 [pF] and 30 [pF]. In the respective states where these three drive load capacities (70 [pF]), 50 [pF] and 30 [pF]) are generated, the data of the pixel 902 $(k-1)_n$ and the data of the pixel 902 $(k+1)_n$ which are adjacent to the pixel 902 $(k)_n$ in the line n are both at the "H" level. This case is not generated in the state where the drive load capacities 90 [pF] and 110 [pF] are generated.

Based on the foregoing aspects, the load judging circuit 906 can select one of the output circuits 908L and 908S by comparing the signal levels of the data of the pixel 902 $(k-1)_n$ and the pixel 902 $(k+1)_n$ in the line n. By regulating as above, the acute change of the output can be controlled while the circuit configuration is simplified at the same time.

It is judged concretely as follows whether or not the drivability of the output circuit (908S or 908L), that is currently selectively driven, is within the demanded range (comparison of the drive load capacity to the threshold value (70 [pF] or the like). The output circuits 908S and 988L are both connected to the pixel to be controlled 902 $(k)_n$. One of the outputs in the output circuits 908S and 908L is selected by the selecting circuit 909.

Focusing on the display line n where the pixel to be controlled 902 $(k)_n$ is present and the line n−1 prior thereto, and further focusing on the pixel to be controlled 902 $(k)_n$ on the display line n and the pixel 903 $(k)_{n-1}$ on the display line n−1 (positioned in the same order as the pixel to be controlled 902 $(k)_n$), it is first judged by a load judging circuit 904 whether or not the pixel 902 $(k-1)_n$ and the pixel 903 $(k-1)_{n-1}$ which are adjacent to the pixels 902 $(k)_n$ and 903 $(k)_{n-1}$ in the display lines n and n−1 are both at the "H" level. Similarly, it is first judged by a load judging circuit 904 whether or not the pixel 902 $(k+1)_n$ and the pixel 903 $(k+1)_{n-1}$, which are adjacent to the pixels 902 $(k)_n$ and 903 $(k)_{n-1}$ in the display lines n and n−1 are both at the "H" level Further, it is judged by a load judging circuit 905 whether or not the pixel 902 $(k-1)_n$ and the pixel 903 $(k-1)_{n-1}$ are both at the "H" level, and the pixel 902 $(k+1)_n$ and the pixel 903 $(k+1)_{n-1}$ are both at the "H" level. Further, it is judged by a load judging circuit 906 whether or not the pixel 902 $(k-1)_n$ and the pixel 902 $(k+1)_n$ adjacent to the pixel to be controlled 902 $(k)_n$ are both at the "H" level in the display line n.

Furthermore, under the conditions that the pixel 902 $(k-1)_n$ and the pixel 903 $(k-1)_{n-1}$ are both at the "H" level, and the pixel 902 $(k+1)_n$ and the pixel 903 $(k+1)_{n-1}$ are both at the "H" level, it is judged by a load judging circuit 907 whether or not the pixel 902 $(k-1)_n$ and the pixel 902 $(k+1)_n$ adjacent to the pixel to be controlled 902 $(k)_n$ are both at the "H" level in the display line n.

The selecting circuit 909 selects the output of the output circuit 908S when all of the judgments by the load judging circuit 907 are positive, while selecting the output of the output circuit 908L when all of them are not positive. The selecting circuit 909 may be controlled based on the judgment result of the load judging circuit 905 without providing the load judging circuits 906 and 907.

Though the preferred embodiments of this invention have been described in detail, it will be understood that various modifications may be made therein, and it is intended to cover in the appended claims all such modifications as fall within the true spirit and scope of this invention.

What is claimed is:

1. A display panel drive-control device comprising:

a first latch circuit for temporarily memorizing a display pixel data by one line;

a second latch circuit for temporarily memorizing a preceding display pixel data that precedes the display pixel data by one line;

a load judging circuit for judging a transition state of the display pixel data based on the display pixel data and the preceding display pixel data and predicting a drive load capacity based on a result of the judgment;

a drivability adjusting circuit for adjusting a signal level of the display pixel data based on a result of the prediction of the drive load capacity;

wherein the drivability adjusting circuit comprises:

a signal level adjusting circuit for adjusting the display pixel data to have such a signal level that is necessary for the display; and a drivability adjustment output circuit for adjusting a drivability of the display pixel data which is level-adjusted with the signal level adjusting circuit in accordance with a prediction result of the drive load capacity by the load judging circuit, and wherein the drivability adjusting circuit comprises:

a plurality of drivability adjustment output circuits having different levels of drivability respectively; and a selector for selecting the drivability adjustment output circuit suitable for the drive load capacity from the plurality of drivability adjustment output circuits.

2. A display panel drive-control device comprising:

a first latch circuit for temporarily memorizing a display pixel data by one line;

a second latch circuit for temporarily memorizing a preceding display pixel data that precedes the display pixel data by one line;

a load judging circuit for judging a transition state of the display pixel data based on the display pixel data and the preceding display pixel data and predicting a drive load capacity based on a result of the judgment;

a drivability adjusting circuit for adjusting a signal level of the display pixel data based on a result of the prediction of the drive load capacity; and a delay adjusting circuit for delaying an output timing of the display pixel data so as to synchronize the output timing with an output timing of the prediction result by the load judging circuit.

3. A display panel drive-control device comprising:

a first latch circuit for temporarily memorizing a display pixel data by one line;

a second latch circuit for temporarily memorizing a preceding display pixel data that precedes the display pixel data by one line;

a load judging circuit for judging a transition state of the display pixel data based on the display pixel data and the preceding display pixel data and predicting a drive load capacity based on a result of the judgment;

a drivability adjusting circuit for adjusting a signal level of the display pixel data based on a result of the prediction of the drive load capacity; and a data shift circuit for fetching the display pixel data by one scanning line while shifting the display pixel data in accordance with a pixel clock.

4. A display panel drive-control method comprising:

a comparing step for comparing a group of display pixel data consisting of three pixels, that are a pixel to be controlled $(k)_n$ and pixels $(k-1)_n$ and $(k+1)_n$ adjacent thereto on both sides thereof in a scanning line n, to a group of preceding display pixel data consisting of three pixels, that are a pixel $(k)_{n-1}$ corresponding to the pixel to be controlled $(k)_n$ and pixels $(k-1)_{n-1}$ and $(k+1)_{n-1}$ adjacent thereto on both sides thereof in a scanning line n −1 immediately before the scanning line n;

a predicting step for monitoring a state of data transition from the preceding display pixel data to the display pixel data based on a comparison result obtained in the comparing step and predicting a drive load capacity based on an monitoring result thereby obtained; and a signal level adjusting step for adjusting a signal level of the display pixel data based on a prediction result thereby obtained.

5. The display panel drive-control method as claimed in claim 4, wherein the comparing step further includes:

a first comparing step for comparing the display pixel data of the pixel $(k-1)_n$ to the display pixel data of the pixel $(k-1)_{n-1}$ and comparing the display pixel data of the pixel $(k+1)_n$ to the display pixel data of the pixel $(k+1)_{n-1}$; and a second comparing step for comparing the display pixel data of the pixel (k31 1)$_n$ to the display pixel data of the pixel $(k+1)_n$, wherein the predicting step monitors the data transition state from the preceding display pixel data to the display pixel data based on results of the comparisons in the first and second comparing steps in the predicting step.

* * * * *